United States Patent [19]

Abtahi

[11] Patent Number: 4,892,226

[45] Date of Patent: Jan. 9, 1990

[54] PORTABLE APPARATUS FOR REFRIGERATED STORAGE AND TRANSPORTATION OF COSMETICS AND THE LIKE

[76] Inventor: Nooral S. Abtahi, 1400 Barton Rd., #109, Redlands, Calif. 92373

[21] Appl. No.: 233,066

[22] Filed: Aug. 17, 1988

[51] Int. Cl.[4] ..... B65D 85/72

[52] U.S. Cl. ..... 220/412; 220/428; 206/385; 62/457.1; 62/371

[58] Field of Search ..... 220/428, 412; 206/385; 62/457, 530, 371, 372

[56] References Cited

U.S. PATENT DOCUMENTS

| | | | |
|---|---|---|---|
| 2,457,043 | 12/1948 | Histand | 62/457 |
| 3,262,283 | 7/1966 | Taylor | 62/457 |
| 4,211,091 | 7/1980 | Campbell | 62/372 |
| 4,429,793 | 2/1984 | Ehmann | 62/457 |
| 4,514,993 | 5/1985 | Johnson | 62/457 |
| 4,688,572 | 8/1987 | Hubbard | 383/901 |

*Primary Examiner*—George E. Lowrance
*Assistant Examiner*—G. W. Reece
*Attorney, Agent, or Firm*—Shefte, Pinckney & Sawyer

[57] ABSTRACT

A cosmetic case having a removable refrigerant pack is provided for protecting cosmetics from heat degradation during transport and temporary storage in warm weather climates. The side walls of the case interior are covered with an absorbent material and flaps of the absorbent material are provided for enclosing the refrigerant pack to absorb any condensation and maintain the cosmetics substantially dry.

13 Claims, 2 Drawing Sheets

PORTABLE APPARATUS FOR REFRIGERATED STORAGE AND TRANSPORTATION OF COSMETICS AND THE LIKE

BACKGROUND OF THE INVENTION

The present invention relates broadly to carrying bags and cases for cosmetics and, more particularly, to a novel portable device adapted for refrigerated temporary storage and transportation of heat-sensitive cosmetics and the like.

Many conventional cosmetic products, such as lipsticks, facial foundations and other lotions and creams, mascara, eye liner, eye shadows, etc., are formulated with a base material which is commonly a wax-like or cream-like substance. As will thus be understood, such products are relatively sensitive to heat and accordingly are subject to melting, cracking or other degradation when exposed to heat, even for relatively short periods of time in some cases. Since women typically carry a supply of many such cosmetic items with them at substantially all times, this characteristic of such products can be particularly problematic for women in warm weather climates.

SUMMARY OF THE INVENTION

It is accordingly an object of the present invention to provide a portable apparatus adapted for refrigerated temporary storage and transportation of heat-sensitive cosmetics and the like.

This objective is satisfied by the present invention which, briefly summarized, provides a closable case whose walls define an interior area in which cosmetics and similar items may be contained. A refrigerant pack which is conformable to the walls of the case is provided for selective insertion and removable from the case interior. Further, a suitably absorbent arrangement is provided for generally enclosing the refrigerant pack when inserted in the case in conformity to its walls in order to absorb any condensation from the refrigerant pack thereby to keep the cosmetics substantially dry.

Preferably, the case is constructed with a plurality of side walls with the refrigerant pack being foldable for conforming with the walls, The absorbent arrangement comprises a first web of an absorbent sheet material, e.g. a flexible sponge-like material, affixed to the interior case walls and a second web of the absorbent material movable with respect to the first web to be foldable over the refrigerant pack when it is inserted in the interior of the case. The interior walls of the case and the refrigerant pack are provided with matable fasteners to retain the pack in place in conformity to the walls when inserted within the case. As desired, the case may be formed of a flexible textile material to be at least partially collapsible. The refrigerant pack preferably has a liquid-tight body containing a freezable liquid material.

DESCRIPTION OF THE PREFERRED EMBODIMENT

Figure 1:
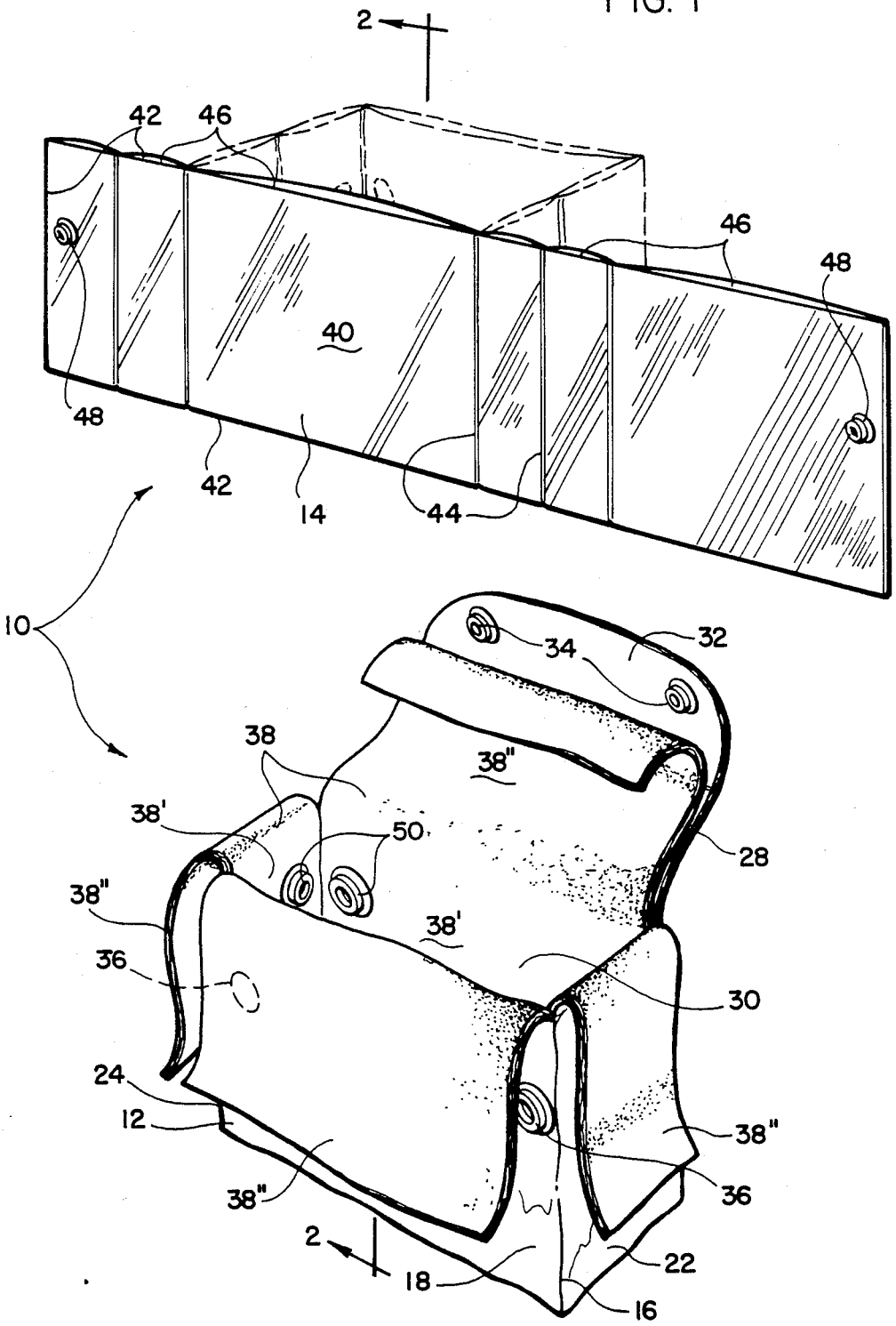
FIG. 1 is an exploded perspective view of a portable apparatus for refrigerated temporary storage and transportation of heat-sensitive cosmetics according to the preferred embodiment of the present invention.

Referring now to the accompanying drawings and initially to FIG. 1, a portable apparatus for refrigerated temporary storage and transportation of heatsensitive cosmetics and like items is indicated generally at 10 in exploded form and basically includes a carrying case 12 in which a refrigerant pack 14 may be selectively inserted and removed.

The carrying case 12 has an outer shell or housing 16 formed of a textile fabric or other suitably flexible material fabricated in a hollow, generally parallelepiped box-like configuration with parallel facing front and back side walls 18, 20 and transverse parallel facing lateral side walls 22, 24 extending therebetween a bottom wall 26 joining the respective lower margins of such side walls, and a top wall 28 pivotably attached along the upper margin of the back wall 20 for movement into and out of covering relation to the interior area 30 defined by the shell 16. A closure flap 32 extends from the forward edge of the cover 28 and is provided with snap-type fasteners 34 for connection with mating fasteners 36 affixed at corresponding locations to the exterior surface of the front wall 18 for securing the cover 28 in its closed position when desired.

Each of the front, back and lateral side walls 18, 20, 22, 24 has a relatively thin sheet 38 of a flexible absorbent material, such as a foam or sponge-like material, affixed over part of the sheet's extent 38' to the inwardly-facing surface of the wall to substantially cover the entire surface area thereof, with a unitary extent 38" of the sheet material of substantially the same surface area extending from the upper margin of the fixed extent of each sheet but otherwise unattached to the shell 16 of the case 12 to form a flap foldable into the interior area 30 of the shell 16 in adjacent facing parallel relation to the fixed extent 38' of the sheet 38. In this manner, the refrigerant pack 14 may be essentially enclosed between the dual webs 38', 38" of each sheet 38 when inserted within the case 12, as more fully described hereinafter. The flexible character of the textile material forming the shell 16 and the absorbent sheet material 38 affixed in its interior provide the case 12 with a degree of collapsibility, which may be increased or enhanced as desired by forming the lateral side walls 22, 24 and the bottom wall 26 of a pleated nature for front-to-rear collapsibility in a manner similar to that of many conventional purses and handbags.

The refrigerant pack 14 is fabricated of two elongated rectangular webs 40 of plastic sheet material heat sealed together in facing parallel relation along their respective perimeter edges as at 42 and at transverse seal lines as at 44 spaced along the longitudinal extent of the webs 40 to form several liquid-tight compartments 46 within each of which a quantity of a freezable liquid is contained. Substantially any suitable freezable liquid may be utilized, such as water or any of several conventional freezable jell-like substances. The transverse seal lines 44 in the plastic webs 40 of the refrigerant pack 14 enable it to be folded into a rectangular configuration conforming to the side walls 18, 20, 22, 24, while also providing the refrigerant pack 14 with a sufficient degree of collapsibility from such rectangular disposition to conform to the collapsible nature of the case 12.

Figure 2:
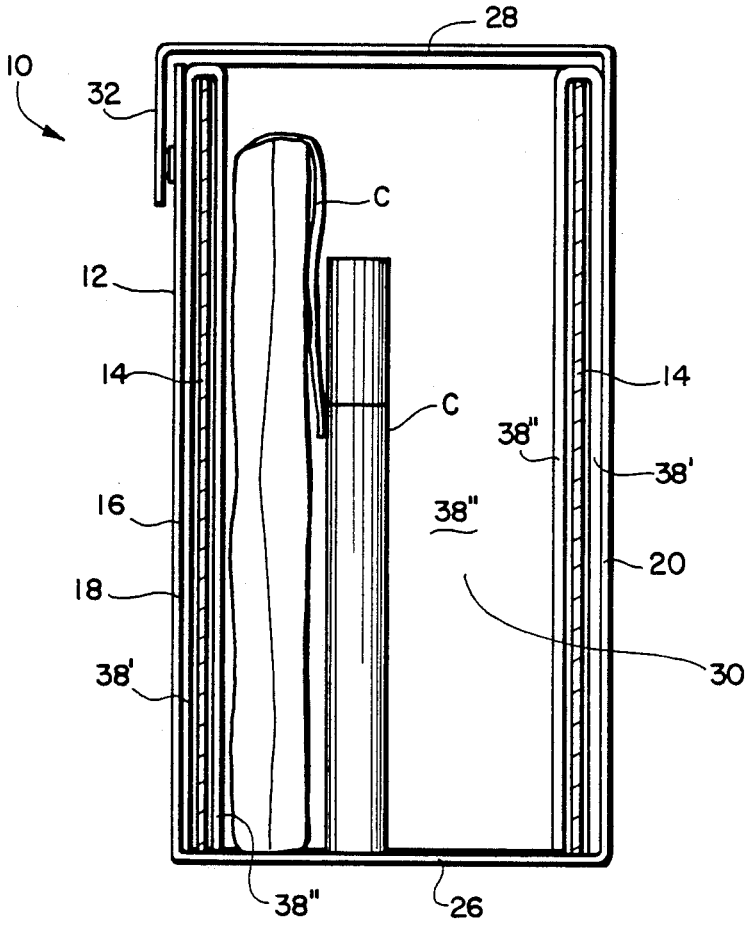
FIG. 2 is a vertical cross-sectional view of the apparatus of FIG. 1 in assembled form taken along line 2—2 thereof.

In use, the refrigerant pack 14 is initially placed in a sub-freezing environment, such as the freezer area of a home refrigerator, to freeze the liquid material contained within the pack 14. Once frozen, the pack 14 is folded as aforedescribed into a rectangular shape and inserted into the interior area 30 of the case 12 in conformity to its side walls 18, 20, 22, 24. The flaps 38" of the absorbent sheets 38 are folded over the refrigerant pack 14 to enclose it between the two webs of each sheet 38 formed by its fixed extent 38' and its flap 38". To secure and maintain the refrigerant pack in place, snap-type fasteners 48 may be affixed to each opposite end of the refrigerant pack 14 and mating fasteners 50 may be affixed within the interior of the case 12 at a corner thereof for connection with the fasteners 48 of the pack 14. The interior area 30 of the case 12 may then be filled as described with cosmetic items to be carried with the user, such as representatively indicated at C in FIG. 2. The frozen refrigerant pack 14 will, of course, be substantially cooler than the ambient environment and will therefore serve to cool the interior area 30 and the cosmetic items C contained therein to prevent or at least substantially retard the effects of elevated ambient temperatures on the cosmetic items C. Further, the absorbent nature of the sheet material 38 serves to absorb any condensation developing on the exterior of the refrigerant pack 14 to maintain the interior area 30 and the cosmetics C substantially dry. Advantageously, therefore, the apparatus 10 of the present invention will enable users in warm weather climates to protect their cosmetic items from premature degradation due to heat so that the full life and use of cosmetics can be realized.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A portable apparatus for refrigerated temporary storage and transportation of heat-sensitive cosmetics and the like, comprising:

a. A closable case having wall means defining an interior receiving area for cosmetics and like items;

b. a refrigerant pack conformable to said wall means of said case for selective insertion and removal therefrom; and c. means for generally enclosing said refrigerant pack when conformed to and inserted in said case, said enclosing means having an absorbent surface for absorption of condensation from said refrigerant pack comprising a first web of an absorbent sheet material affixed to said wall means within said interior receiving area and a second web of said absorbent sheet material movable with respect to said first web to be foldable into and out of covering relation to said refrigerant pack when said refrigerant pack is inserted into said receiving area.

2. A portable apparatus for refrigerated temporary storage and transportation of heat sensitive cosmetics and the like according to claim 1 and characterized further in that said case has a plurality of side walls and said refrigerant pack is foldable into conformity with said side walls.

3. A portable apparatus for refrigerated temporary storage and transportation of heat sensitive cosmetics and the like according to claim 1 and characterized further in that said absorbent sheet material is a flexible spongelike material.

4. A portable apparatus for refrigerated temporary storage and transportation of heat sensitive cosmetics and the like according to claim 1 and characterized further in that said wall means and said refrigerant pack having matable affixation means for retaining said refrigerant pack in place in conformity to said wall means when said refrigerant pack is inserted in said receiving area.

5. A portable apparatus for refrigerated temporary storage and transportation of heat sensitive cosmetics and the like according to claim 1 and characterized further in that said case is formed of a flexible textile material and is configured to be at least partially collapsible.

6. A portable apparatus for refrigerated temporary storage and transportation of heat sensitive cosmetics and the like according to claim 1 and characterized further in that said refrigerant pack comprises a liquid-tight body containing a freezable liquid material.

7. A portable apparatus for refrigerated temporary storage and transportation of heat-sensitive cosmetics and the like, comprising:

a. A closable case having wall means defining an interior receiving area for cosmetics and like items;

b. a refrigerant pack conformable to said wall means of said case for selective insertion and removal therefrom;

c. means for generally enclosing said refrigerant pack when conformed to and inserted in said case, said enclosing means having an absorbent surface for absorption of condensation from said refrigerant pack; and d. matable affixation means secured respectively to said wall means and said refrigerant pack for retaining said refrigerant pack in place in conformity to said wall means when said refrigerant pack is inserted in said receiving area.

8. A portable apparatus for refrigerated temporary storage and transportation of heat-sensitive cosmetics and the like according to claim 7 and characterized further in that said case has a plurality of side walls and said refrigerant pack is foldable into conformity with said side walls.

9. A portable apparatus for refrigerated temporary storage and transportation of heat-sensitive cosmetics and the like according to claim 7 and characterized further in that said enclosing means is affixed to said wall means of said case within its said interior receiving area.

10. A portable apparatus for refrigerated temporary storage and transportation of heat-sensitive cosmetics and the like according to claim 9 and characterized further in that said enclosing means comprises a first web of an absorbent sheet material affixed to said wall means and a second web of said absorbent sheet material movable with respect to said first web and to be foldable over said refrigerant pack when said refrigerant pack is inserted into said receiving area.

11. A portable apparatus for refrigerated temporary storage and transportation of heat-sensitive cosmetics and the like according to claim 10 and characterized further in that said absorbent sheet material is a flexible spongelike material.

12. A portable apparatus for refrigerated temporary storage and transportation of heat-sensitive cosmetics and the like according to claim 7 and characterized further in that said case is formed of a flexible textile material and is configured to be at least partially collapsible.

13. A portable apparatus for refrigerated temporary storage and transportation of heat-sensitive cosmetics and the like acocrding to claim 7 and characterized further in that said refrigerant pack comprises a liquid-tight body containing a freezable liquid material.

* * * * *

UNITED STATES PATENT AND TRADEMARK OFFICE

CERTIFICATE OF CORRECTION

PATENT NO. : 4,892,226

DATED : January 9, 1990

INVENTOR(S) : Nooral S. Abtahi

It is certified that error appears in the above-identified patent and that said Letters Patent is hereby corrected as shown below:

Column 1, Line 38, reads "removable" but should read -- removal --.

Column 1, Line 46, reads "walls," but should read -- walls. --.

Column 2, Line 6, reads "heatsensitive" but should read -- heat-sensitive --.

Column 2, Line 16, after "therebetween" add -- , --.

Column 2, Line 43, reads "affixed in its" but should read -- affixed to its --.

Column 3, Line 14, reads "described" but should read -- desired --.

Column 5, Line 1, after "web" delete -- and --.

Signed and Sealed this

Sixth Day of October, 1992

*Attest:*

DOUGLAS B. COMER

*Attesting Officer*

*Acting Commissioner of Patents and Trademarks*